US009257802B2

(12) United States Patent
Yu et al.

(10) Patent No.: US 9,257,802 B2
(45) Date of Patent: Feb. 9, 2016

(54) SLIDABLE LOW PROFILE ELECTRICAL CONNECTOR

(71) Applicant: ALLTOP ELECTRONICS (SUZHOU) LTD., Taicang, JiangSu Province (CN)

(72) Inventors: Wang-I Yu, Shanghai (CN); Siu-Mien Yang, Shanghai (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/516,929

(22) Filed: Oct. 17, 2014

(65) Prior Publication Data

US 2015/0037990 A1 Feb. 5, 2015

Related U.S. Application Data

(63) Continuation-in-part of application No. 13/608,762, filed on Sep. 10, 2012, now Pat. No. 8,888,516.

(30) Foreign Application Priority Data

Jul. 3, 2012 (CN) ..... 2012 1 0226881
Aug. 12, 2014 (CN) ..... 2014 1 0391703

(51) Int. Cl.
*H01R 24/64* (2011.01)
*H01R 13/639* (2006.01)

(52) U.S. Cl.
CPC ..... *H01R 24/64* (2013.01); *H01R 13/639* (2013.01)

(58) Field of Classification Search
CPC ..... H01R 24/62; H01R 13/447; H01R 24/64
See application file for complete search history.

(56) References Cited

U.S. PATENT DOCUMENTS

| | | | |
|---|---|---|---|
| 5,385,479 | A | 1/1995 | Okada |
| 5,411,405 | A | 5/1995 | McDaniels et al. |
| 5,538,442 | A | 7/1996 | Okada |
| 5,547,401 | A | 8/1996 | Aldous et al. |
| 5,562,472 | A | 10/1996 | Dubois et al. |
| 5,562,504 | A | 10/1996 | Moshayedi |
| 5,634,802 | A | 6/1997 | Kerklaan |
| 5,637,018 | A | 6/1997 | Gargiulo |
| 5,679,013 | A | 10/1997 | Matsunaga et al. |
| 5,727,972 | A | 3/1998 | Aldous et al. |
| 5,816,832 | A | 10/1998 | Aldous et al. |
| 5,971,777 | A | 10/1999 | Garside |
| 5,980,322 | A | 11/1999 | Madsen et al. |
| 5,989,042 | A | 11/1999 | Johnson et al. |
| 6,005,774 | A | 12/1999 | Chiba et al. |
| 6,115,256 | A | 9/2000 | Centofante |
| 6,129,566 | A | 10/2000 | Davis et al. |
| 6,142,834 | A | 11/2000 | Liao |
| 6,155,882 | A | 12/2000 | Wu |

(Continued)

*Primary Examiner* — Ross Gushi
(74) *Attorney, Agent, or Firm* — Sughrue Mion, PLLC

(57) ABSTRACT

An electrical connector includes a base with a number of contacts, a cover pivotally mounted to the base, a pair of supporting components for mating with the cover and a pair of rail brackets for mating with the base. Each supporting component is pivotal between an opening status and a closed status relative to the base. The base is slidable relative to the rail brackets along a front-to-back direction. The cover and the pair of supporting components are mateable with each other in condition that one of the cover and the pair of supporting components pivots clockwise while a remaining one of the cover and the pair of supporting components pivots anticlockwise.

20 Claims, 17 Drawing Sheets

(56) References Cited

U.S. PATENT DOCUMENTS

| | | | | |
|---|---|---|---|---|
| 6,159,037 | A | 12/2000 | Madsen et al. | |
| 6,186,803 | B1 | 2/2001 | Garside | |
| 6,190,186 | B1 | 2/2001 | Liao | |
| 6,193,522 | B1 | 2/2001 | Liao | |
| 6,198,632 | B1 | 3/2001 | Goff | |
| 6,375,479 | B1 | 4/2002 | Johnson et al. | |
| 6,386,922 | B1 | 5/2002 | Forte et al. | |
| 6,398,564 | B1 | 6/2002 | Wong | |
| 6,398,565 | B1 | 6/2002 | Johnson et al. | |
| 6,409,549 | B1 | 6/2002 | Yeh | |
| 6,428,347 | B1 | 8/2002 | Johnson et al. | |
| 6,482,019 | B1 | 11/2002 | Lo Forte et al. | |
| 6,524,122 | B1 | 2/2003 | Johnson et al. | |
| 6,542,358 | B1 | 4/2003 | Kunz et al. | |
| 6,561,824 | B1 | 5/2003 | Beckham et al. | |
| 6,905,351 | B1 | 6/2005 | Wang et al. | |
| 6,932,656 | B2 | 8/2005 | Kan | |
| 6,971,921 | B1 | 12/2005 | Lai | |
| 7,331,812 | B2 * | 2/2008 | Nishio | H01R 13/639 439/331 |
| 7,841,876 | B2 | 11/2010 | Lin et al. | |
| 7,950,936 | B2 | 5/2011 | Wang et al. | |
| 8,337,222 | B2 | 12/2012 | Hung et al. | |
| 8,465,304 | B2 | 6/2013 | Yen | |
| 8,758,032 | B2 | 6/2014 | Liang et al. | |
| 8,888,516 | B2 * | 11/2014 | Yu | H01R 24/64 439/144 |
| 9,083,106 | B2 * | 7/2015 | Lin | H01R 13/518 |
| 2001/0019907 | A1 | 9/2001 | Glad et al. | |
| 2007/0077797 | A1 | 4/2007 | Reid et al. | |
| 2008/0050953 | A1 | 2/2008 | Reid et al. | |
| 2010/0227486 | A1 | 9/2010 | Lin et al. | |
| 2012/0052704 | A1 | 3/2012 | Yen | |
| 2013/0034979 | A1 | 2/2013 | Chang et al. | |
| 2013/0072042 | A1 | 3/2013 | Liao | |
| 2014/0011379 | A1 | 1/2014 | Yu et al. | |
| 2014/0134858 | A1 | 5/2014 | Tseng et al. | |
| 2014/0134859 | A1 | 5/2014 | Lee et al. | |
| 2014/0187064 | A1 | 7/2014 | Yu et al. | |
| 2015/0037990 | A1 * | 2/2015 | Yu | H01R 24/64 439/142 |

* cited by examiner

SLIDABLE LOW PROFILE ELECTRICAL CONNECTOR

CROSS REFERENCE TO RELATED APPLICATIONS

The present application is a continuation-in-part of U.S. patent application Ser. No. 13/608,762 filed Sep. 10, 2012, now in condition for allowance, which claims priority from Chinese patent application Ser. No. 201210226881.X filed Jul. 3, 2012. The present application also claims the priority of Chinese patent application Ser. No. 201410391703.1 filed Aug. 12, 2014 in the SIPO (State Intellectual Property Office of the P.R.C.). The content of above-referenced patent applications is incorporated by reference herein in its entirety.

BACKGROUND

1. Technical Field

The present disclosure relates to an electrical connector, and more particularly, to a slidable low profile RJ 45 connector easily for receiving a plug connector.

2. Description of Related Art

Notebook computers are usually provided with a number of input/output ports, such as USB ports, RJ 45 ports, VGA ports and some memory card slots, for meeting different applications. With the notebook computers becoming light, thin, short and small, connectors mounted therein should be thinner and thinner.

A conventional RJ 45 connector is rectangular shaped in integral configuration and usually includes an insulative housing, a number of contacts retained in the insulative housing and a metallic shell enclosing the insulative housing. The insulative housing defines a plug-receiving cavity for receiving a reticle plug. Obviously, since the insulative housing is integrally formed in manufacturing, the height thereof is difficult to reduce and control.

Hence, it is desirable to provide a low profile electrical connector.

SUMMARY

The present disclosure provides a slidable electrical connector including a base, a plurality of contacts retained in the base, a cover pivotally mounted to the base, a pair of supporting components for mating with the cover, and a pair of rail brackets for mating with the base. The base includes a plug-receiving cavity. Each contact includes a resilient contacting portion protruding into the plug-receiving cavity. The cover is pivotal between an opening status and a closed status relative to the base along a first pivot member. Each supporting component is pivotal between an opening status and a closed status relative to the base along a second pivot member. The base is slidable relative to the rail brackets along a front-to-back direction between a closed position where the base does not protrude from the rail brackets and an opened position where the base protrudes from the rail brackets. The cover and the pair of supporting components are mateable with each other in condition that one of the cover and the pair of supporting components pivots clockwise while a remaining one of the cover and the pair of supporting components pivots anticlockwise.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF ILLUSTRATED EMBODIMENTS

Figure 1:
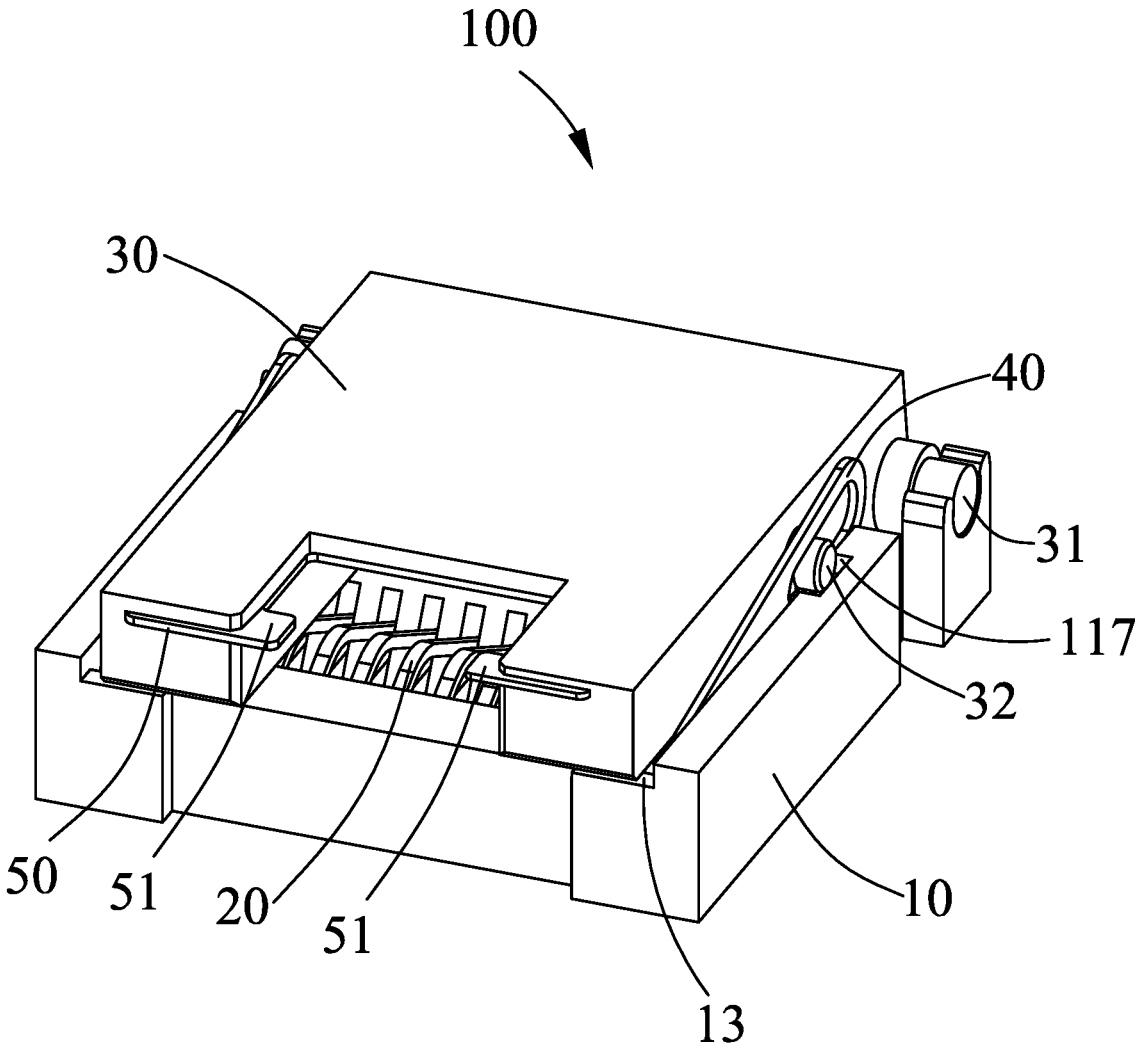
FIG. 1 is a perspective view of an electrical connector with a cover and a pair of supporting components pivotal to a closed location, in accordance with a first embodiment of the present disclosure.

Reference will now be made to the drawing figures to describe the embodiments of the present disclosure in detail. In the following description, the same drawing reference numerals are used for the same elements in different drawings.

Figure 2:
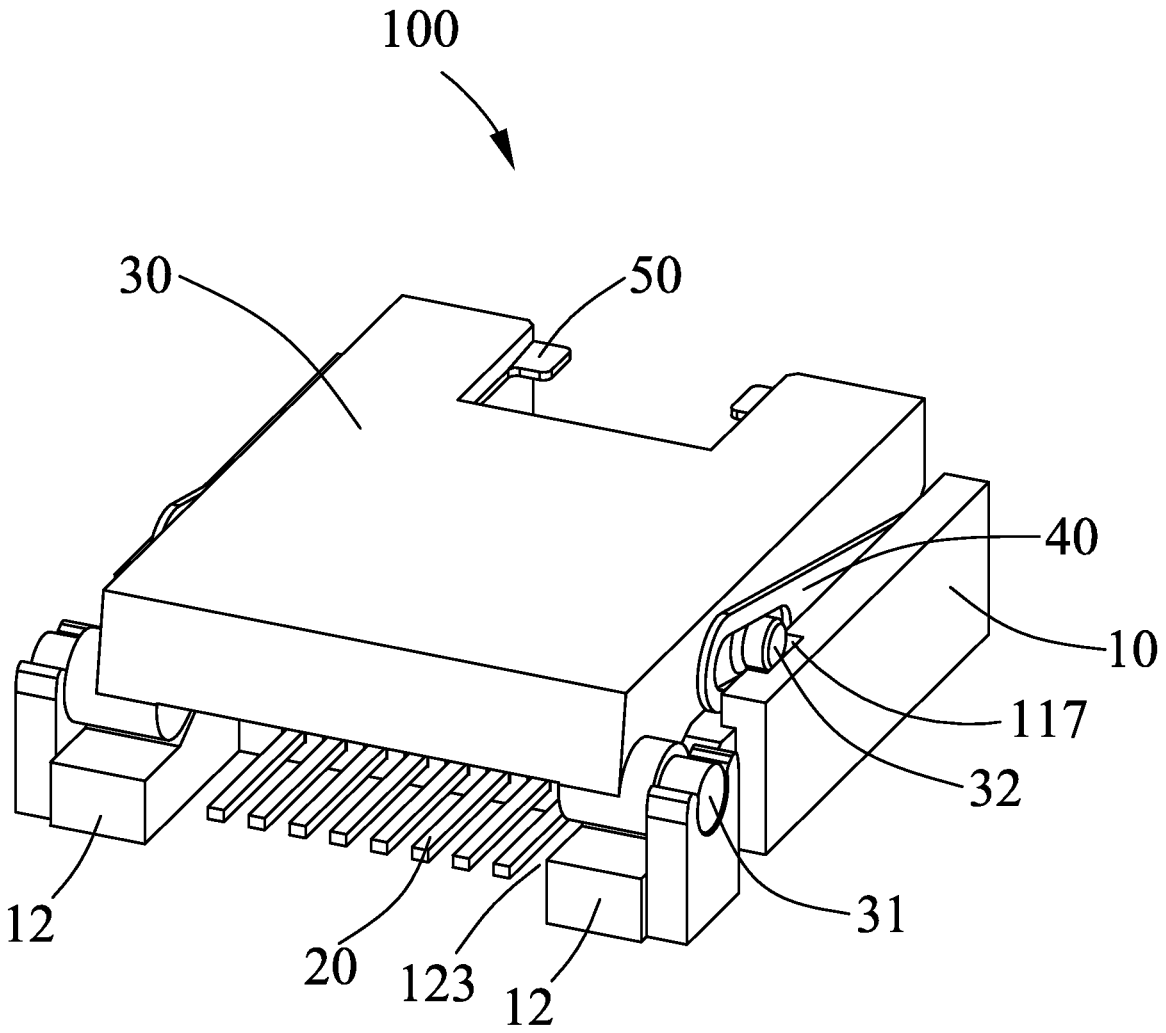
FIG. 2 is a perspective view of the electrical connector as shown in FIG. 1 while taken from a different aspect.
Figure 15:
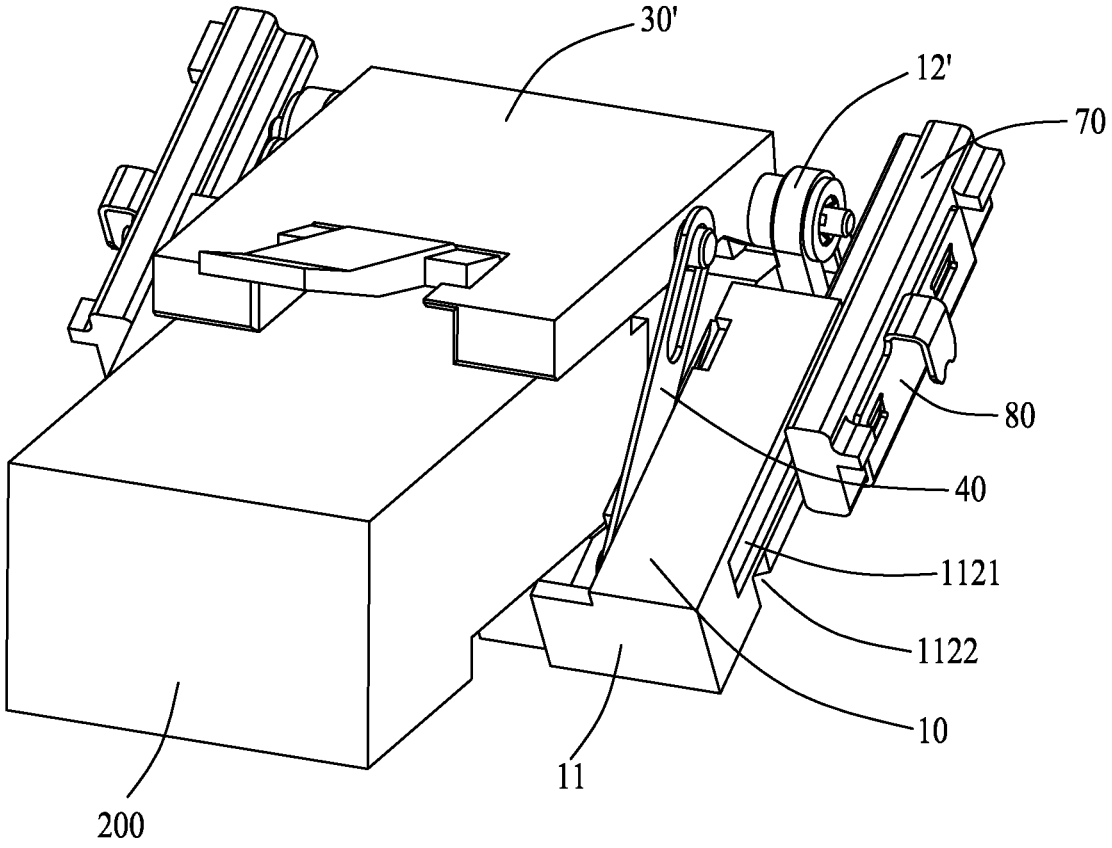
FIG. 15 is a perspective view of the electrical connector with a plug connector inserted thereinto.
Figure 17:
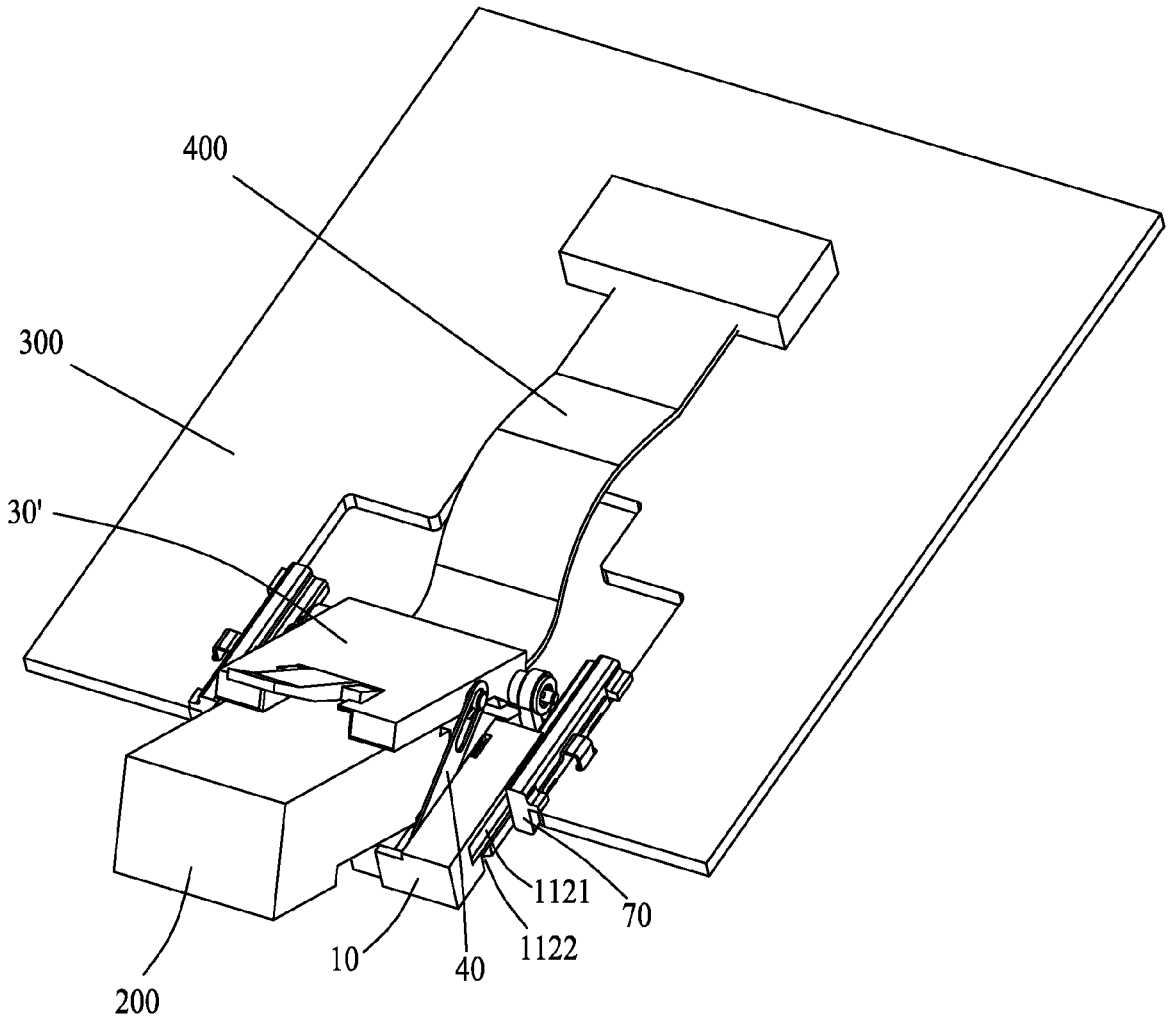
FIG. 17 is a perspective view of the electrical connector assembly shown in FIG. 16 with the plug connector inserted thereinto.

Referring to FIGS. 1 and 2, the present disclosure discloses an electrical connector 100 for being mounted in an electronic device, such as a notebook computer, for receiving a plug connector 200 (shown in FIG. 15 and FIG. 17). The electrical connector 100 includes an insulative base 10, a plurality of contacts 20 retained in the base 10, a cover 30 pivotally mounted at a rear of the base 10 and a pair of supporting components 40 for mating with the cover 30. According to the illustrated embodiments of the present disclosure, the electrical connector 100 is a kind of RJ 45 connector.

Figure 3:
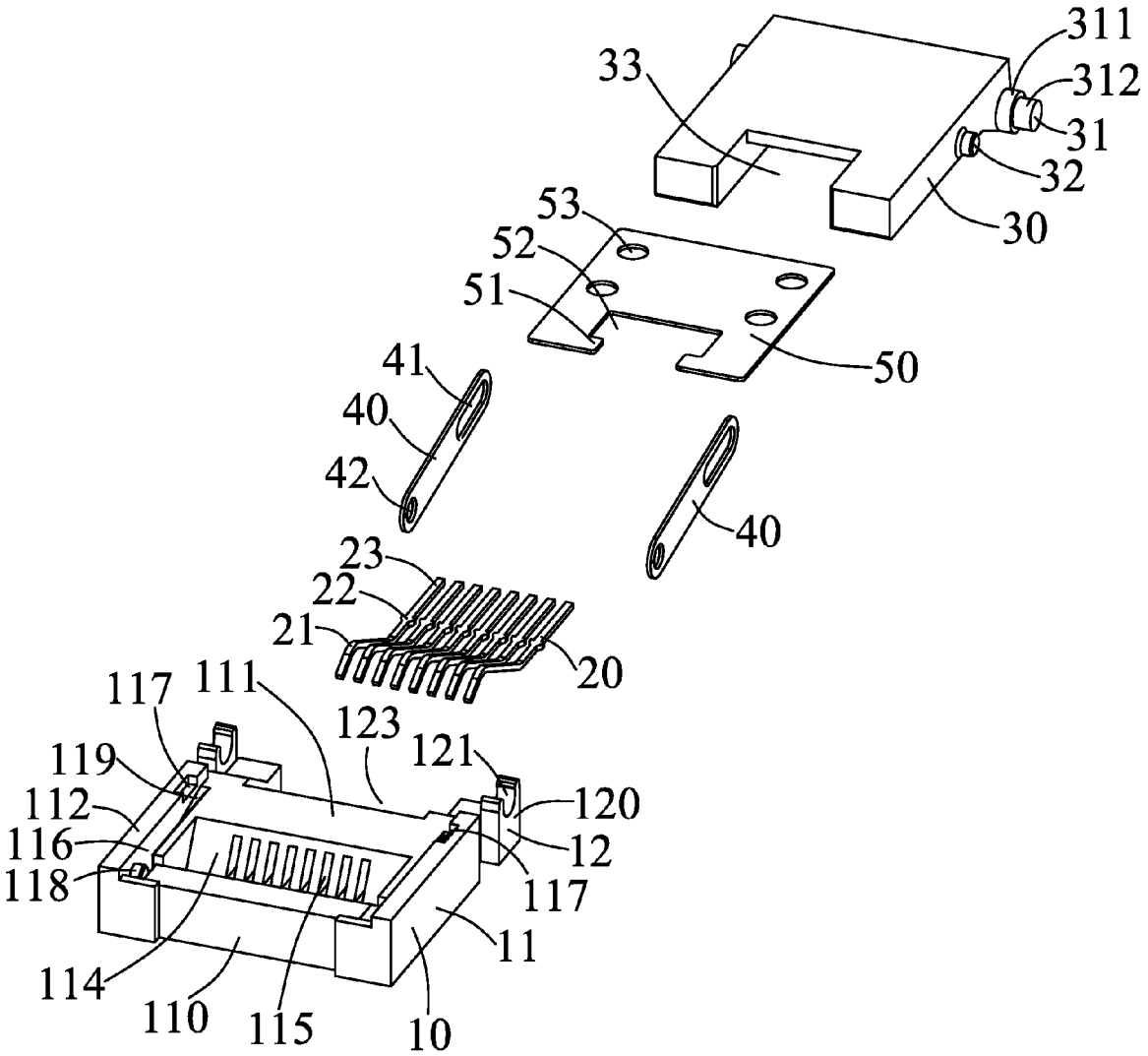
FIG. 3 is an exploded view of the electrical connector as shown in FIG. 1.
Figure 4:
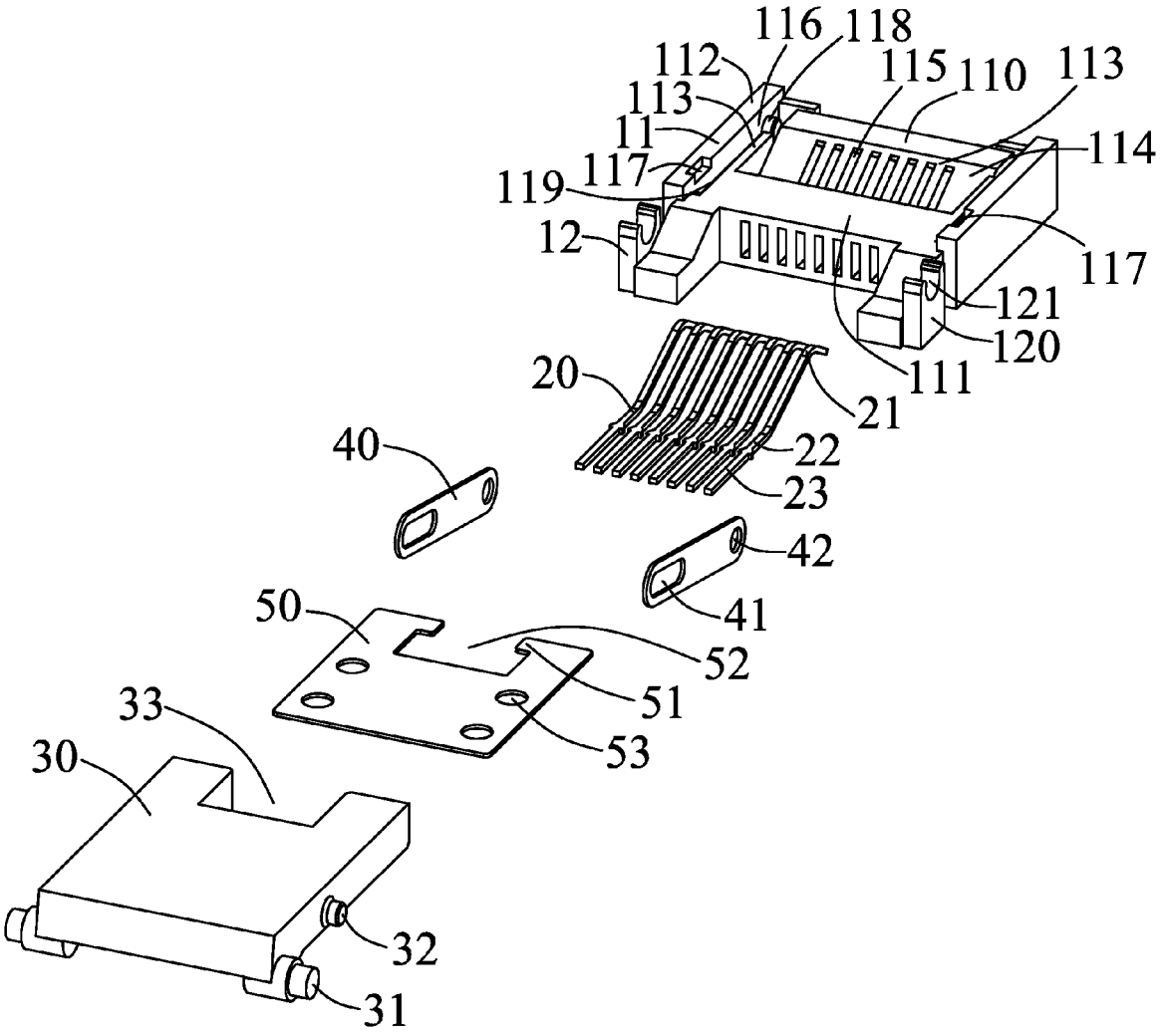
FIG. 4 is an exploded view of the electrical connector as shown in FIG. 2.

Referring to FIGS. 3 and 4, the base 10 includes a main portion 11 and a pair of pivot portions 12 at the rear of the main portion 11. The main portion 11 is of a substantial rectangular configuration and includes a front wall 110, a rear wall 111 and a pair of side walls 112. A plug-receiving cavity 114 is formed between the front wall 110 and the rear wall 111, and between the pair of side walls 112 as well. The front wall 110 includes a slant guiding surface 113 exposed to the plug-receiving cavity 114 for obliquely guiding insertion of the plug connector 200 into the plug-receiving cavity 114. The rear wall 111 defines a plurality of passageways 115 in communication with the plug-receiving cavity 114 for receiving the contacts 20. Each side wall 112 defines a slit 116, an inclined surface 119 at a bottom of the slit 116 and a rectangular notch 117 outside of the slit 116. Besides, a space 123 is formed between the pair of pivot portions 12. The space 123 is separated from the plug-receiving cavity 114 by the rear wall 111 along a front-to-back direction. Each pivot portion 12 includes a bracket 120 which defines a cutout 121 formed thereon. Each cutout 121 is opened at its top side. According to the illustrated embodiments of the present disclosure, a cross section of each cutout 121 is semicircular for easily receiving a corresponding portion of the cover 30.

Figure 16:
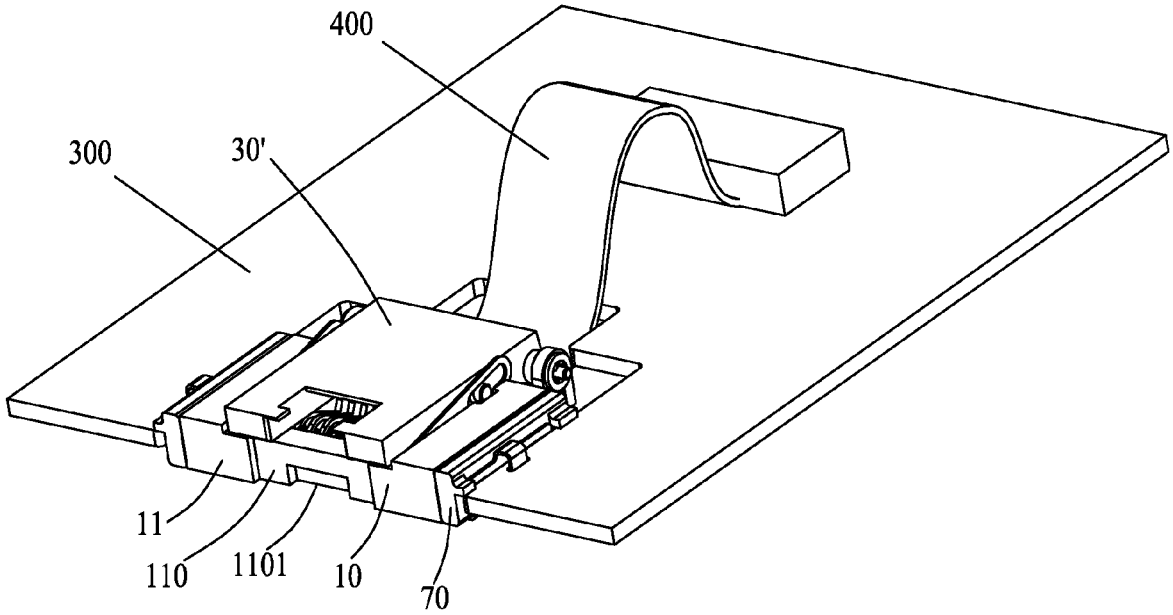
FIG. 16 is a perspective view of an electrical connector assembly with the electrical connector shown in FIG. 9 mounted to a circuit board.

Referring to FIGS. 1 to 4, each contact 20 includes a retaining portion 22 fixed in the passageway 115, a resilient contacting portion 21 protruding forwardly into the plug-receiving cavity 114 for mating with the plug connector 200, and a tail portion 23 extending backwardly into the space 123 for mounting to a flexible printed circuit 400 (shown in FIG. 16 and FIG. 17).

Referring to FIGS. 3 and 4, according to the first illustrated embodiment of the present disclosure, the cover 30 is substantially rectangular shaped and is made of an insulative material. The cover 30 includes a pair of first shafts 31 formed on lateral sides thereof and a pair of cylinder protrusions 32 at the front of the first shafts 31. Each first shaft 31 is comprised of a larger cylinder 311 and a smaller cylinder 312 which is coaxial with the larger cylinder 311. Each first shaft 31 is positioned at a bottom corner of the cover 30. As clearly shown in FIG. 3, a center line of each first shaft 31 is lower than that of each protrusion 32 for not only reducing a height of the electrical connector 100 but also providing robust engaging force between the base 10 and the cover 30. Besides, the cover 30 defines a rectangular front opening 33 opposite to the first shafts 31.

Referring to FIGS. 1 to 5, in order to enhance rigidity of the cover 30, the electrical connector 100 further includes a metallic reinforce piece 50 fixed to the cover 30. The reinforce piece 50 includes a pair of opposite engaging projections 51 both extending into the front opening 33, a second opening 52 corresponding to the front opening 33 and a plurality of holes 53 into which the insulative material of the cover 30 flows during an injection-molding process. As a result, the reinforce piece 50 can be stably embedded in the cover 30.

Figure 5:
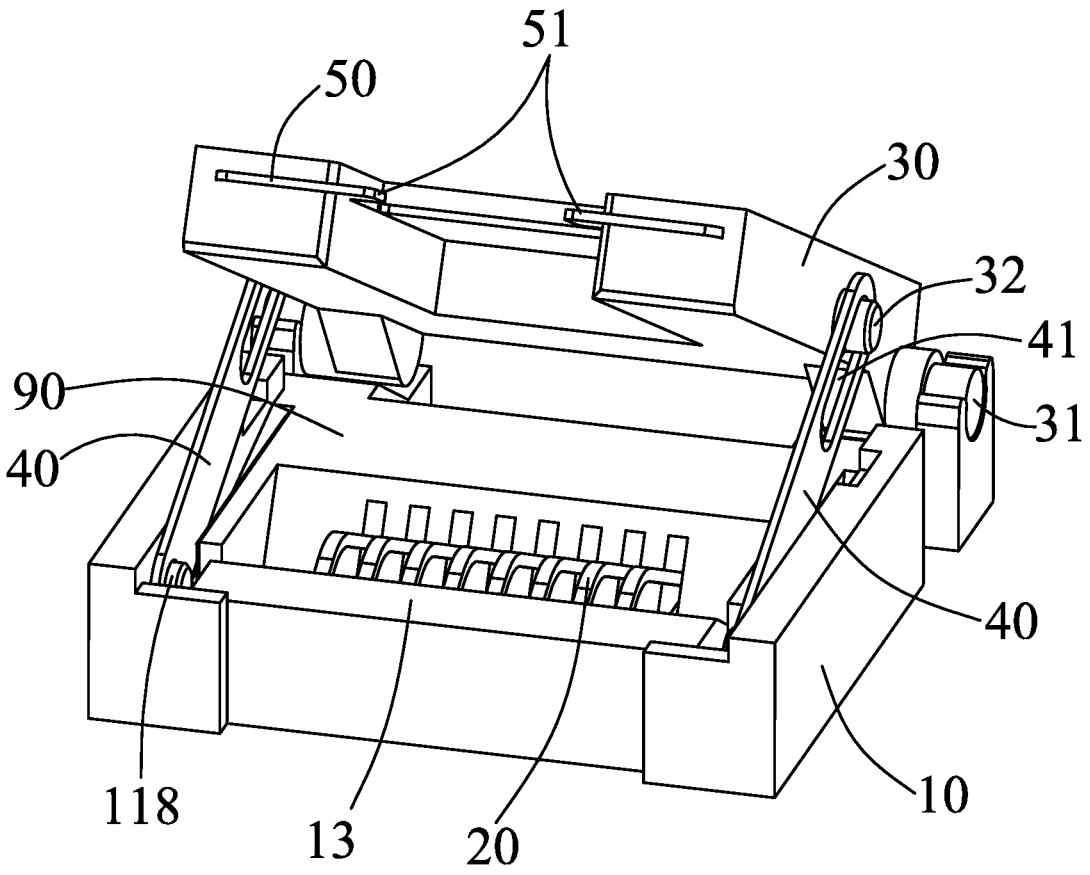
FIG. 5 is a perspective view of the electrical connector with the cover and the pair of supporting components pivotal to an opening location, in accordance with the first embodiment of the present disclosure.

In a word, the cover 30 is pivotal between an opening status (as shown in FIG. 5) and a closed status (as shown in FIG. 1) with respect to the base 10 along a first pivot member. According to the first illustrated embodiment of the present disclosure, the first pivot member includes the pair of first shafts 31 formed on the lateral sides of the cover 30 and the pair of cutouts 121 formed on the base 10. The pair of first shafts 31 are received in the cutouts 121 along a top-to-bottom direction. Since the cutouts 121 are opened at their top sides, the assembly of the first shafts 31 can be clearly observed and becomes easily. As a result, the first shafts 31 are pivotal in the cutouts 121 so that the cover 30 can be pivotal between the opening status and the closed status. Understandably, the first pivot member is not limited to the illustrated embodiment, for example, the first shafts 31 can be formed on the base 10 while the cutouts 121, or round holes, can be formed on the cover 30.

Referring to FIGS. 1 to 5, the pair of supporting components 40 are stamped from a metal sheet. Each supporting component 40 includes round hole 42 at a first end and a longitudinal slot 41 at a second end. Accordingly, each side wall 112 of the base 10 includes a second shaft 118 exposed to the slit 116. In assembling, the second shafts 118 are received in the round holes 42, and the protrusions 32 of the cover 30 are slidably received in the longitudinal slots 41. Each supporting component 40 is pivotal between an opening status and a closed status with respect to the base 10 along a second pivot member. According to the illustrated embodiment of the present disclosure, the second pivot member includes the pair of round holes 42 formed on the pair of supporting components 40 and the pair of second shafts 118 formed in the base 10. The pair of second shafts 118 are pivotal in the round holes 42 so that the supporting components 40 can be pivotal between the opening status and the closed status. Understandably, the second pivot member is not limited to the illustrated embodiment, for example, the second shafts 118 can be formed on the supporting components 40 while the round holes 42 can be formed on the base 10.

Referring to FIGS. 1 and 5, the protrusions 32 are positioned between the first shafts 31 and the second shafts 118 along the front-to-back direction. Each protrusion 32 is slidable in corresponding longitudinal slot 41 either when the cover 30 pivots from the opening status to the closed status or when the cover 30 pivots from the closed status to the opening status. In detail, one of the cover 30 and the pair of supporting components 40 pivots clockwise while a remaining one of the cover 30 and the pair of supporting components 40 pivots anticlockwise. As shown in FIG. 5, the cover 30 and the supporting components 40 are pivotal to an opening location where the plug connector can be inserted into the plug-receiving cavity 114 through an opening 90. As shown in FIG. 1, the cover 30 and the supporting components 40 are pivotal to a closed location where the plug connector is restricted by the engaging projections 51 so as to be prevented from withdrawing from the plug-receiving cavity 114. At the closed location, the integral configuration of the electrical connector 100 is flat. The cover 30 is essentially parallel to the base 10. It is noticed that, in order to further reduce the height of the electrical connector 100, the base 10 defines an upper depression 13 to partly receive the cover 30 along a vertical direction. A length of the longitudinal slot 41 determines an opening range of the cover 30. Besides, the inclined surfaces 119 support the supporting components 40 when the cover 30 and the supporting components 40 pivotal to the closed location as a result that over-pivot of the supporting components 40 can be avoided. Besides, as shown in FIGS. 1 and 2, at the closed location, the protrusions 32 are at least partly received in the notches 117.

It is understandable to those of ordinary skill in the art that it is much easier to match a color of an insulative cover 30 to that of the electronic device in which the electrical connector 100 is mounted. Usually, such color requirement is important for customer satisfaction. However, if the cover 30 is completely stamped from a metal sheet, since the color of the metal sheet usually does not match that of the electronic device, additional processing, such as coating, about the metal cover can be applied.

Figure 6:
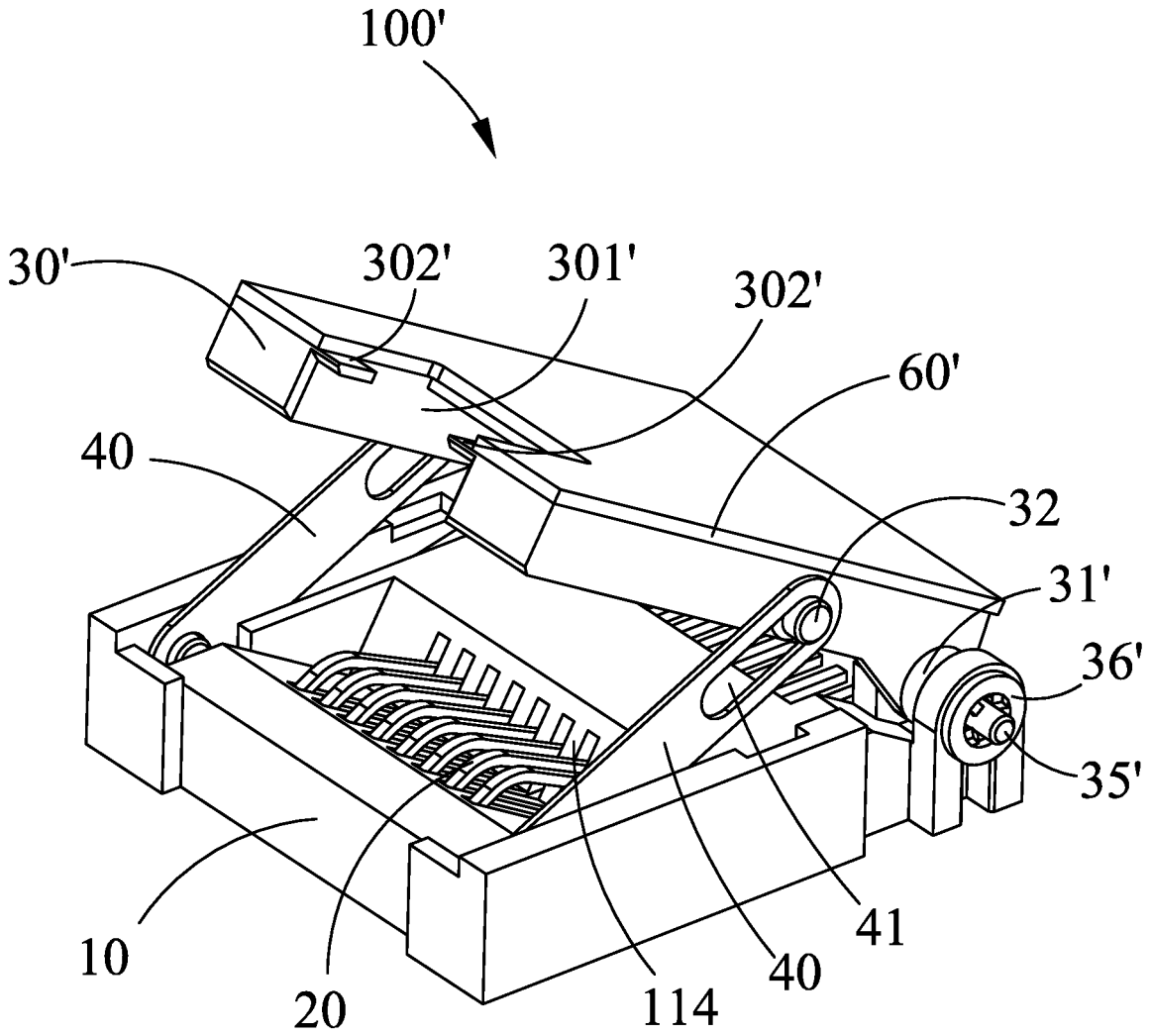
FIG. 6 is a perspective view of the electrical connector with a cover and a pair of supporting components pivotal to an opening location, in accordance with a second embodiment of the present disclosure.
Figure 7:
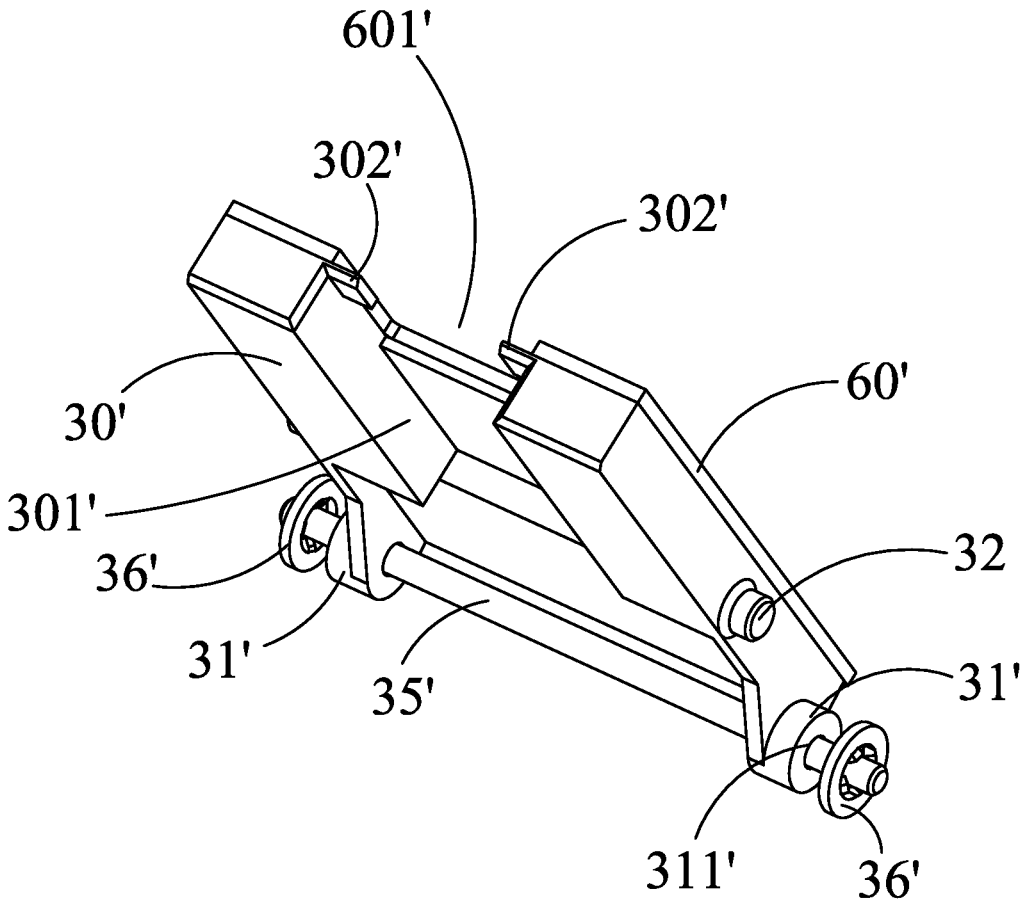
FIG. 7 is a perspective view of a cover member, an axis and a pair of blocking pieces.
Figure 8:
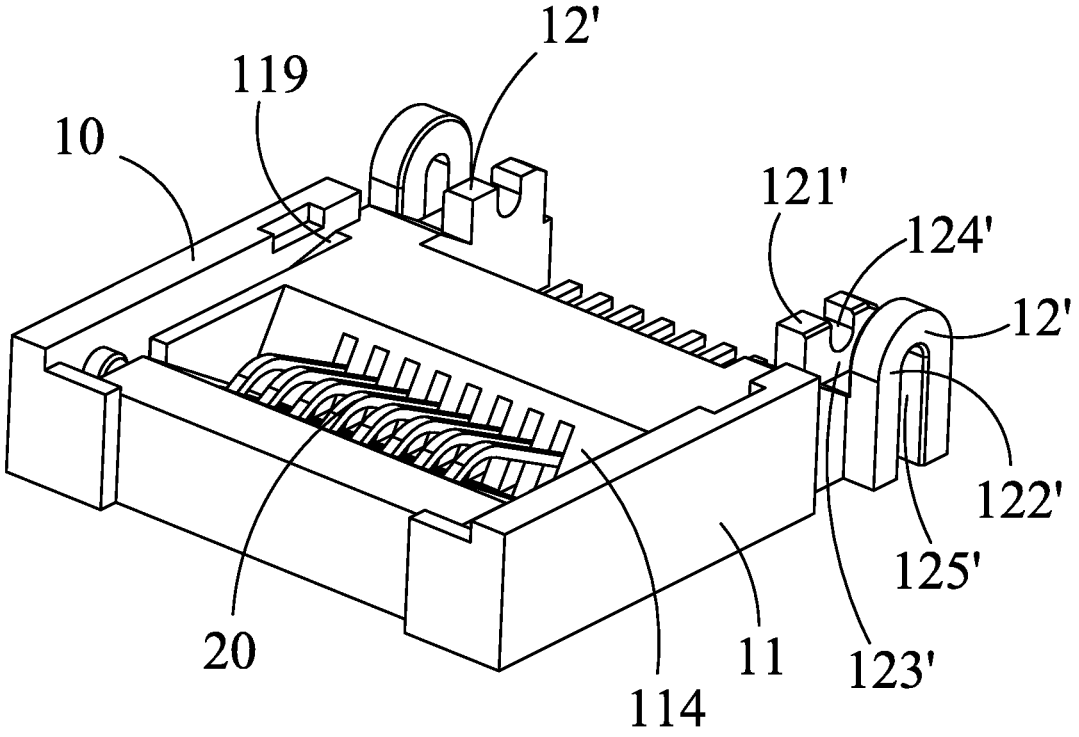
FIG. 8 is a perspective view of a base and a plurality of contacts received in the base.
Figure 9:
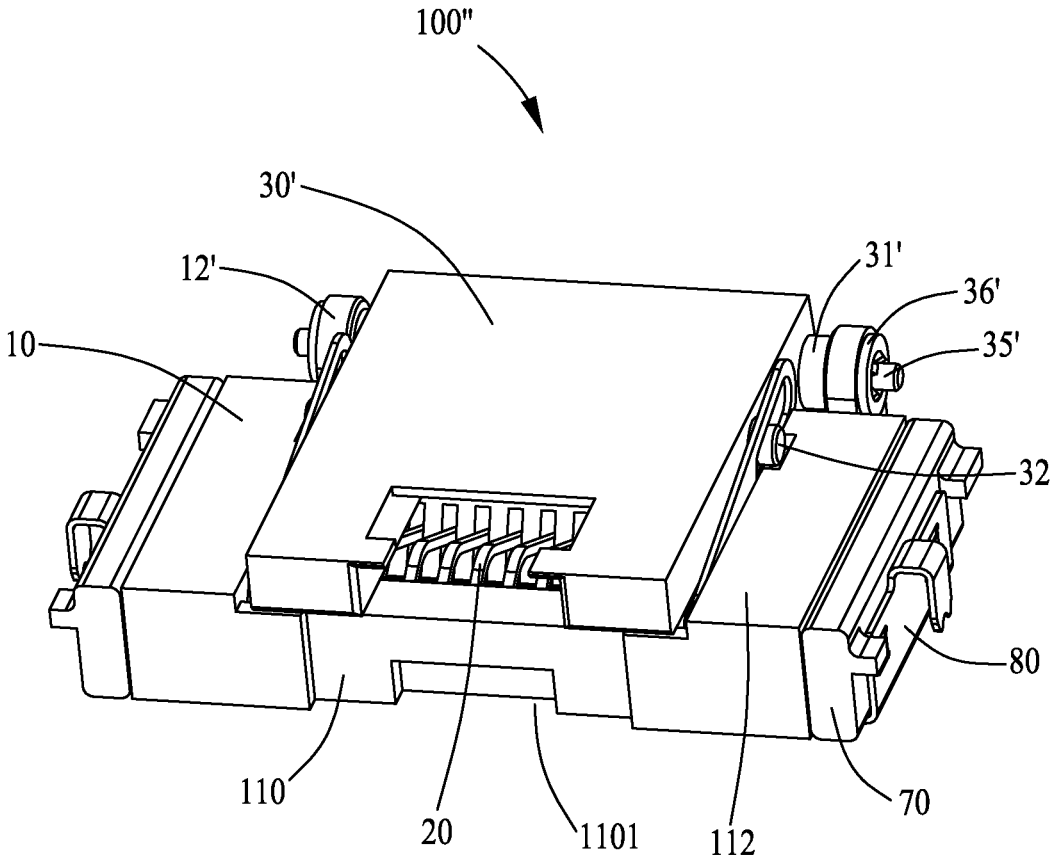
FIG. 9 is a perspective view of an electrical connector with a cover and a pair of supporting components pivotal to a closed location, in accordance with a third embodiment of the present disclosure.
Figure 10:
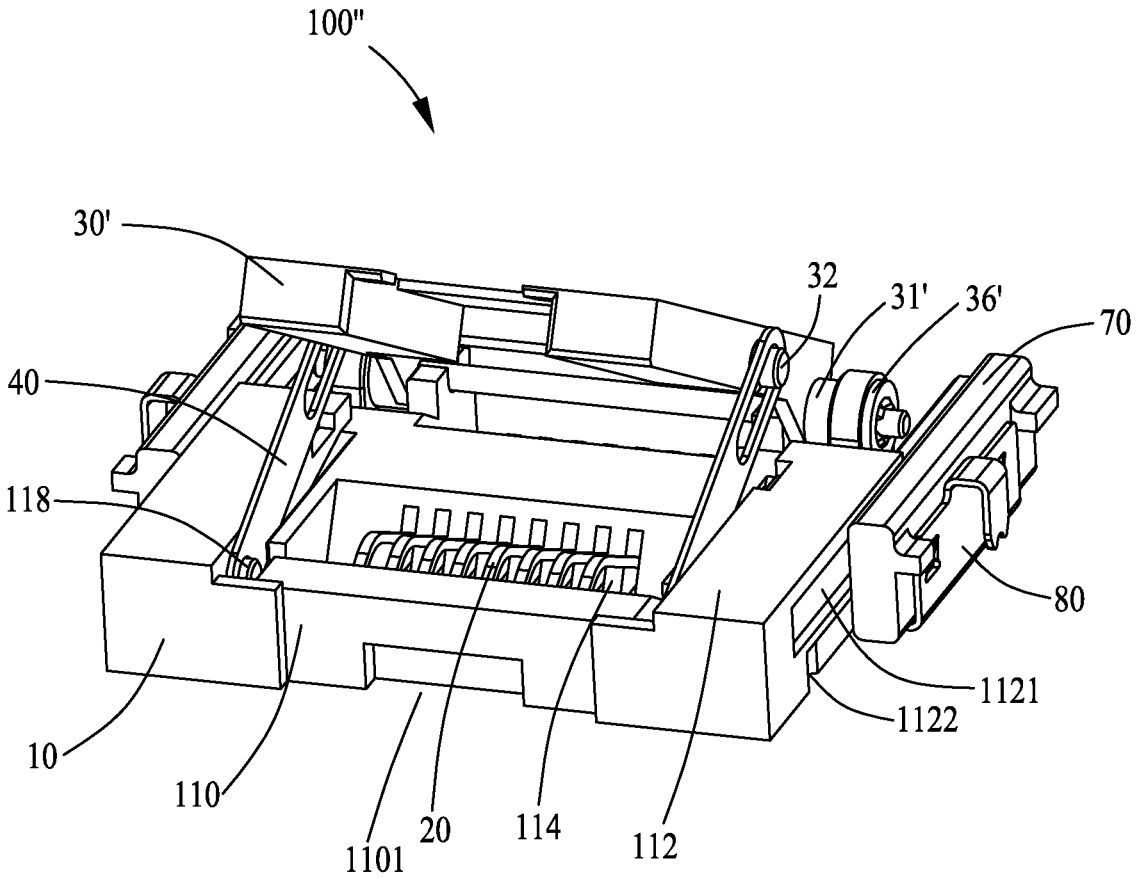
FIG. 10 is a perspective view of the electrical connector with the cover and the pair of supporting components pivotal to an opening location, in accordance with the third embodiment of the present disclosure.

Referring to FIGS. 6 to 8, an electrical connector 100' according to a second embodiment of the present disclosure is disclosed. The electrical connector 100' includes an insulative base 10, a plurality of contacts 20 retained in the base 10, a cover 30' pivotally mounted at a rear of the base 10 and a pair of supporting components 40 for mating with the cover 30'. Since the electrical connector 100' is similar to the electrical connector 100 disclosed in the first embodiment, only main differences therebetween will be depicted in detail hereinafter.

Referring to FIG. 8, the base 10 includes a main portion 11 defining a plug-receiving cavity 114 and a pair of pivot portions 12' at the rear of the main portion 11. Each pivot portion 12' includes an inner wall 121', an outer wall 122', a space 123' between the inner wall 121' and the outer wall 122', and a mounting hole (not labeled) laterally extending through the inner wall 121' and the outer wall 122'. The mounting hole includes a first cutout 124' upwardly opened at a top side of the inner wall 121' and a second cutout 125' downwardly opened at a bottom side of the outer wall 122'.

The cover 30' includes a pair of first shafts 31' formed on lateral sides thereof and a pair of cylinder protrusions 32 at the front of the first shafts 31'. Each first shaft 31' defines a first through hole 311' and is positioned at a bottom corner of the cover 30'. As clearly shown in FIGS. 6 and 7, a center line of each first shaft 31' is lower than that of each protrusion 32 for not only reducing a height of the electrical connector 100' but also providing robust engaging force between the base 10 and the cover 30'. According to the second illustrated embodiment of the present disclosure, the cover 30' is made of a kind of metallic material through press casting for achieve excellent rigidity thereof. The cover 30' includes a front opening 301' and a pair of engaging projections 302' extending into the front opening 301' to restrict the plug connector 200 when the plug connector 200 is received in the plug-receiving cavity 114.

The cover 30' is pivotal between an opening status (as shown in FIG. 6) and a closed status (similar to FIG. 1) with respect to the base 10 along a first pivot member. According to the second illustrated embodiment of the present disclosure, the first pivot member includes the pair of first shafts 31' formed on lateral sides of the cover 30', the pair of mounting holes formed in the base 10 and an axis 35' extending through the first shafts 31' and the mounting holes. The first through holes 311' are in alignment with the mounting holes along a transverse direction perpendicular to the front-to-back direction. The axis 35' are separated made with respect to the cover 30' while is inserted through the first through holes 311' and the mounting holes. The electrical connector 100' further includes a pair of blocking pieces 36' outside of the outer walls 122'. The pair of blocking pieces 36' are attached to the axis 35' from opposite ends for fixing the axis 35'.

Referring to FIGS. 6 and 7, in order for color matching, the electrical connector 100' further includes an insulative layer 60' covering the cover 30'. The color of the insulative layer 60' is the same as or similar to that of the electronic device. Besides, the insulative layer 60' defines a second opening 601' corresponding to the front opening 301'.

Referring to FIGS. 9 to 15, a slidable electrical connector 100" according to a third embodiment of the present disclosure is disclosed. The electrical connector 100" includes an insulative base 10, a plurality of contacts 20 retained in the base 10, a cover 30' pivotally mounted to the base 10 and a pair of supporting components 40 for mating with the cover 30'. Since the electrical connector 100" is similar to the electrical connector 100', only main differences therebetween will be described in detail hereinafter.

Comparing the electrical connector 100', the slidable electrical connector 100" further includes a pair of rail assemblies 70 at opposite sides of the base 10, and a shell 80 combining the base 10 and the rail assemblies 70. The base 10 is slidable with respect to the rail assemblies 70 along the front-to-back direction, and can be pulled out of the rail assemblies 70, which will be depicted hereinafter.

Figure 11:
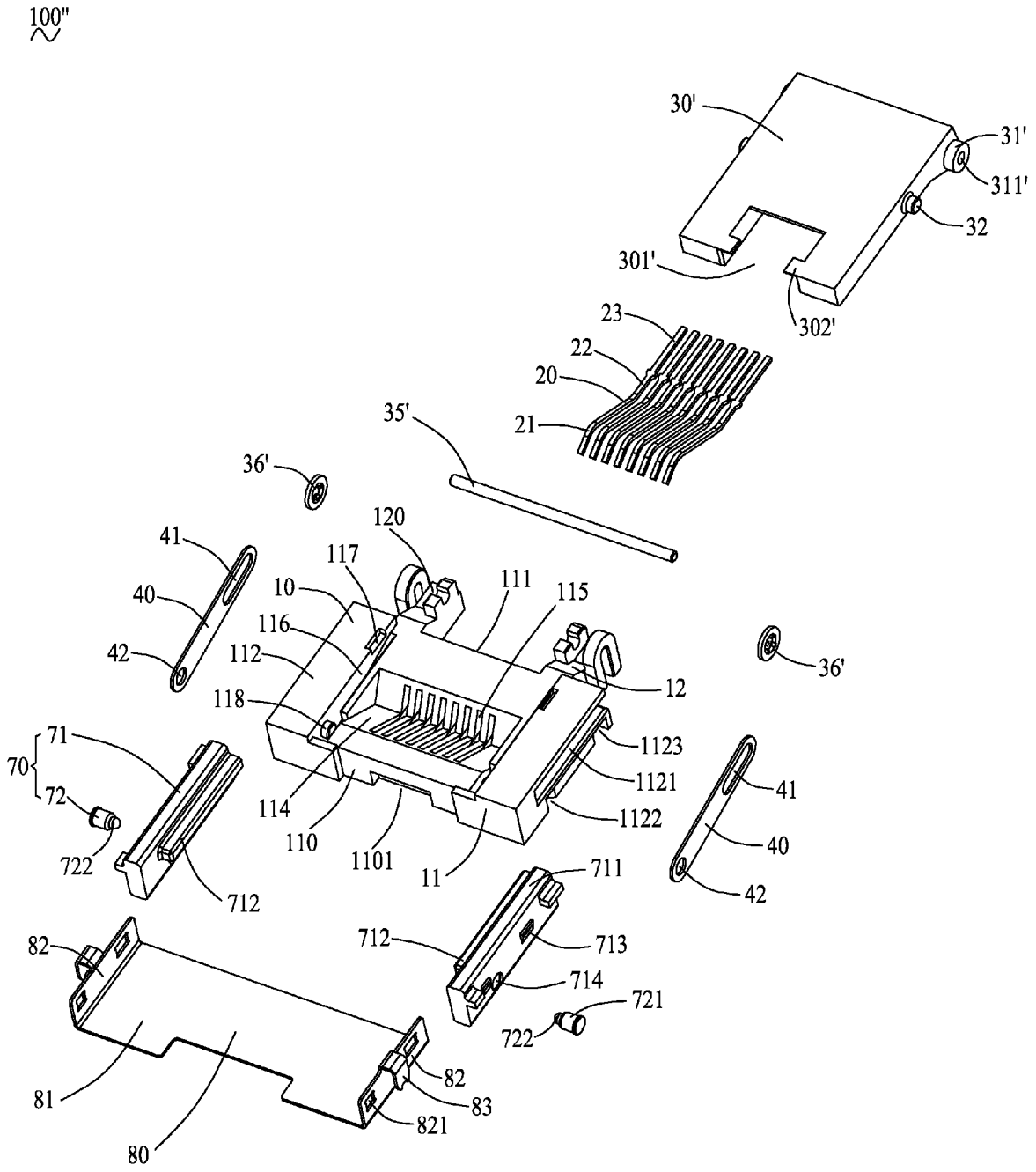
FIG. 11 is an exploded view of the electrical connector as shown in FIG. 9.
Figure 12:
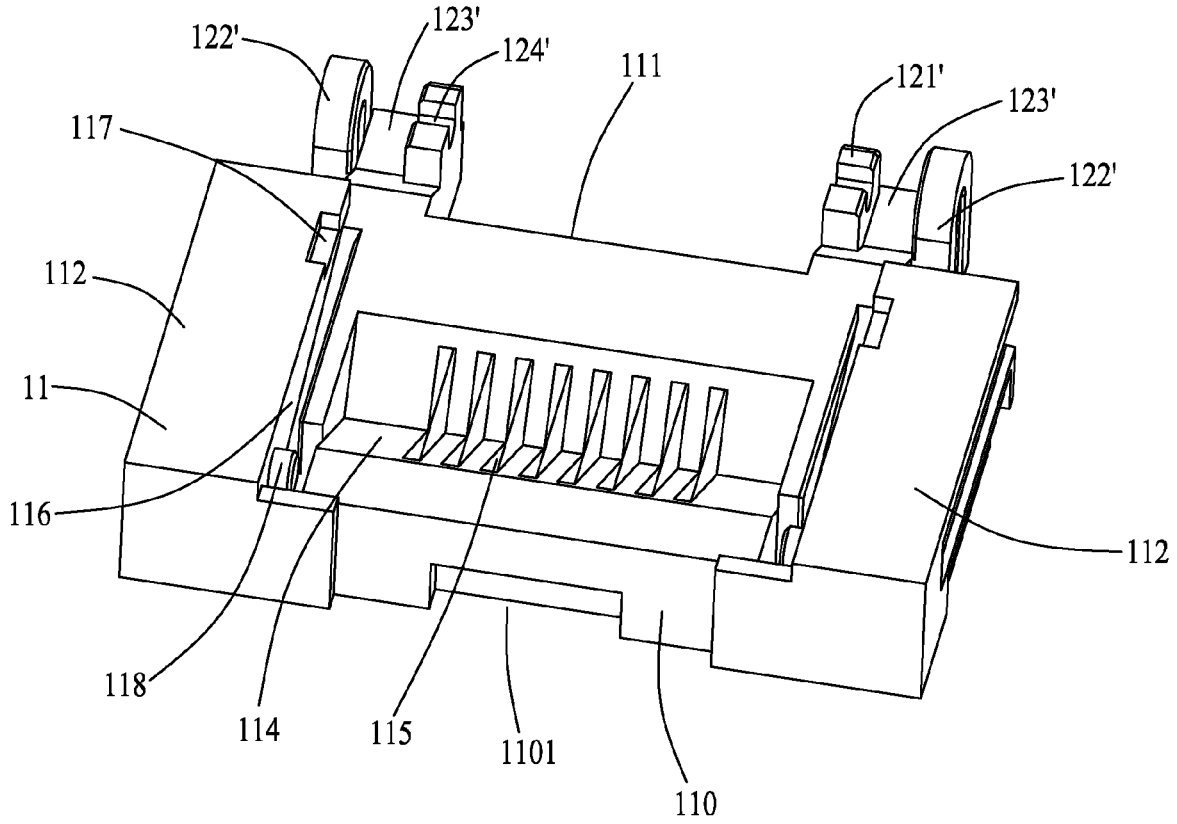
FIG. 12 is a perspective view of a base of the electrical connector as shown in FIG. 11.
Figure 13:
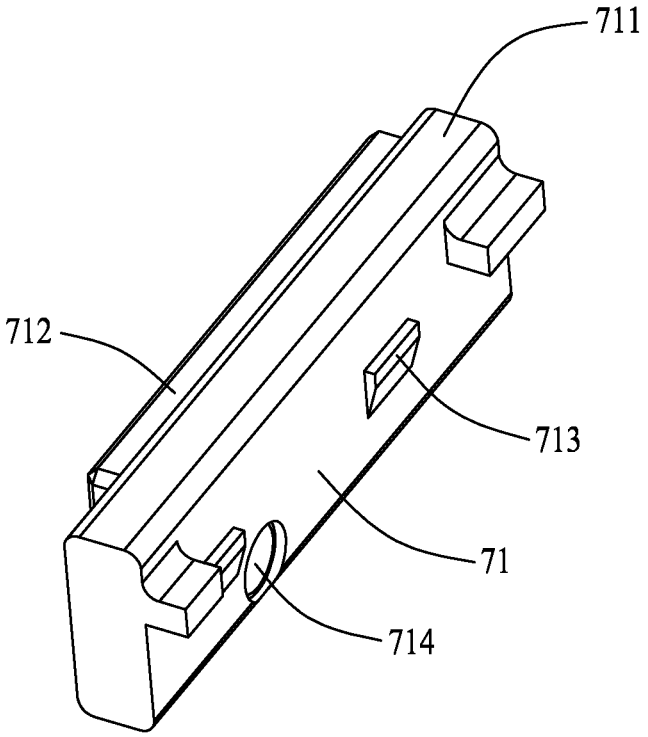
FIG. 13 is a perspective view of one of rail brackets of the electrical connector as shown in FIG. 11.
Figure 14:
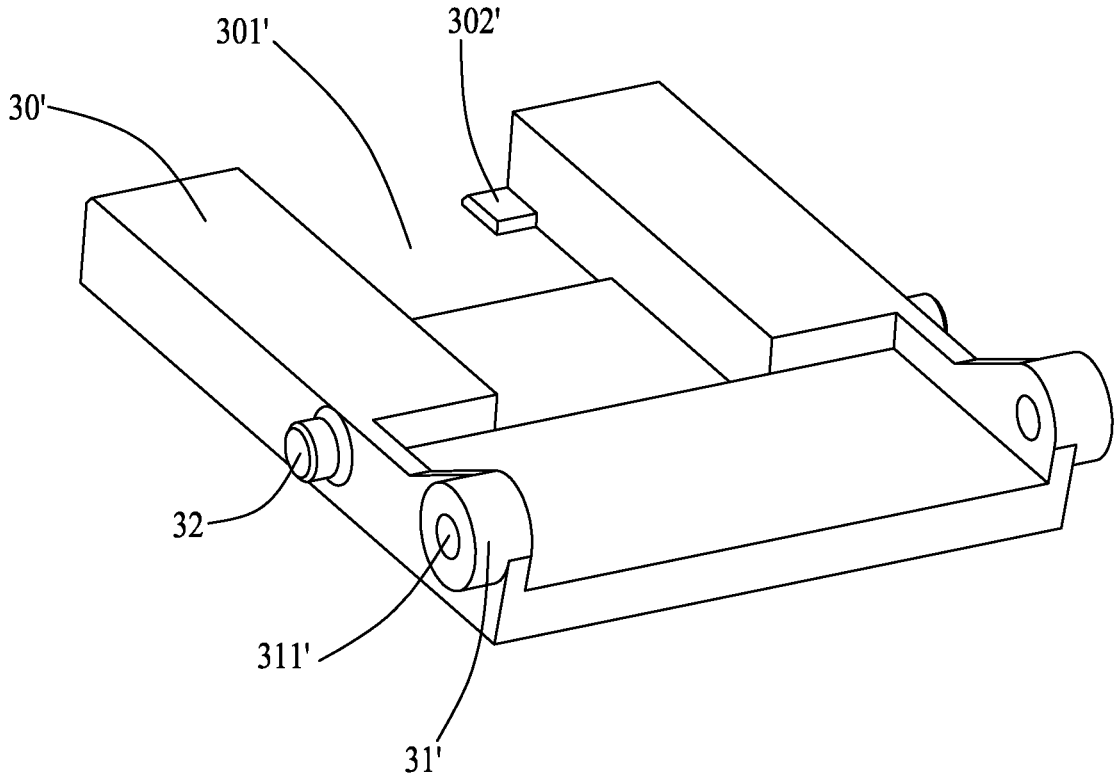
FIG. 14 is a perspective view of the cover of the electrical connector taken along a different aspect.

As shown in FIGS. 9 to 12, the front wall 110 of the base 10 further includes a recess 1101 extending downwardly therethrough. The recess 1101 can be used for end users to apply force in order to expediently pull out the base 10 from the rail assemblies 70. Referring to FIG. 11, each side wall 112 further defines a guide slot 1121 extending backwardly through the rear wall 111, and first and second depressions 1122, 1123 located below the guide slot 1121. The first and the second depressions 1122, 1123 are separated from the guide slot 1121 and are arranged corresponding to opposite ends of the guide slot 1121, respectively.

Each rail assembly 70 includes a rail bracket 71 and a deformable member 72 mounted to the rail bracket 71. The rail bracket 71 includes a body portion 711, a rib 712 protruding inwardly from the body portion 711, a plurality of protrusions 713 formed outward the body portion 711 and a mounting hole 714 extending laterally through the body portion 711. According to the illustrated embodiment of the present disclosure, the deformable member 72 is a pogo pin which includes a stationary portion 721 and an elastic head 722. In assembling, the deformable member 72 is inserted into the mounting hole 714, and the rib 712 is inserted into corresponding guide slot 1121. Understandably, the base 10 is slidable with respect to the rail assemblies 70 along the front-to-back direction between a close position where the deformable members 72 protrude into the first depressions 1122 and an open position where the deformable members 72 protrude into the second depressions 1123.

The shell 80 includes a bottom portion 81 located under the base 10 and the rail assemblies 70, a pair of vertical portions 82 extending upwardly from the bottom portion 81 and a pair of soldering legs 83 bent downwardly from the vertical portions 82. Each vertical portion 82 defines a locking hole 821 for receiving corresponding protrusion 713. After assembly, the base 10 and the rail assemblies 70 are restricted by the pair of vertical portions 82 for combination.

Referring to FIGS. 16 and 17, the present disclosure also provides an electrical assembly with the electrical connector 100" mounted on the circuit board 300 and electrically connected with the flexible printed circuit 400. When it is needed to insert the plug connector 200, the base 10 is firstly pulled out by the end user. In this process, the base 10 slides relative to the rail assemblies 70 from the close position to the open position. Simultaneously, during pulling out the base 10, the cover 30' is gradually opened. As a result, the plug connector 200 can be inserted into the plug-receiving cavity 114. According to the illustrated embodiments of the present invention, the slidable electrical connector 100" can be provided with stable integral structure and is easily to be operated in using. Besides, the electrical connector 100" according to the present disclosures can meet the design requirement of smaller and smaller electronic devices.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A slidable electrical connector comprising:

a base comprising a plug-receiving cavity for receiving a plug connector;

a plurality of contacts retained in the base, each contact comprising a resilient contacting portion protruding into the plug-receiving cavity;

a cover pivotally mounted to the base, the cover being pivotal relative to the base between an opening status and a closed status along a first pivot member;

a pair of supporting components for mating with the cover, each supporting component being pivotal relative to the base between an opening status and a closed status along a second pivot member; and a pair of rail brackets for mating with the base, the base being slidable relative to the rail brackets along a front-to-back direction between a close position where the base does not protrude from the rail brackets and an open position where the base protrudes from the rail brackets; wherein the cover and the pair of supporting components are mateable with each other in condition that one of the cover and the pair of supporting components pivots clockwise while a remaining one of the cover and the pair of supporting components pivots anticlockwise.

2. The slidable electrical connector as claimed in claim 1, wherein slide of the base accompanies pivot of the cover.

3. The slidable electrical connector as claimed in claim 1, wherein the base is positioned between the rail brackets, each rail bracket comprising a body portion and a rib protruding inwardly from the body portion, the base comprising a pair of side walls each of which defines a guide slot to receive corresponding rib, the ribs and the guide slots being slidable with each other.

4. The slidable electrical connector as claimed in claim 3, further comprising a pair of deformable members respectively mounted to the rail brackets, each side wall further comprising a first depression and a second depression separated a distance along the front-to-back direction; wherein when the base is at the close position, the deformable members protrude into the first depressions; and wherein when the base is at the open position, the deformable members protrude into the second depressions.

5. The slidable electrical connector as claimed in claim 4, wherein each body portion comprises a mounting hole and corresponding deformable member is inserted into the mounting hole along a transverse direction perpendicular to the front-to-back direction.

6. The slidable electrical connector as claimed in claim 1, wherein the base comprises a recess to which force can be applied in order to pull out the base from the rail brackets.

7. The slidable electrical connector as claimed in claim 1, further comprising a shell banding the base and the rail brackets, the shell comprising a bottom portion and a pair of vertical portions extending upwardly from the bottom portion, the base and the rail brackets being restricted by the pair of vertical portions.

8. The slidable electrical connector as claimed in claim 1, wherein the first pivot member comprises a pair of first shafts formed on lateral sides of the cover, a pair of mounting holes formed in the base and an axis extending through the first shafts and the mounting holes.

9. The slidable electrical connector as claimed in claim 8, wherein each first shaft defines a first through hole in alignment with the mounting holes along a transverse direction, the axis being separated made relative to the cover and is then inserted through the first through holes and the mounting holes.

10. The slidable electrical connector as claimed in claim 9, wherein the base comprises a pair of backward extensions each of which comprises an inner wall, an outer wall and a space between the inner wall and the outer wall to receive the first shafts.

11. The slidable electrical connector as claimed in claim 10, further comprising a pair of blocking pieces outside of the outer walls, the pair of blocking pieces being attached to the axis from opposite ends for fixing the axis.

12. A slidable electrical connector for being mounted in an electronic device, comprising:

a base defining a plug-receiving cavity;

a plurality of contacts with resilient contacting portions protruding into the plug-receiving cavity for mating with a plug connector;

a cover pivotally mounted at a rear of the base, the cover being pivotal with respect to the base along a first pivot member;

a pair of supporting components for mating with the cover, each supporting component being pivotal with respect to the base along a second pivot member;

a pair of rail brackets for mating with the base, the base being slidable relative to the rail brackets along a front-to-back direction between a close position where the base does not protrude from the rail brackets and an open position where the base protrudes from the rail brackets; wherein each supporting component comprises a slot and the cover comprises a pair of protrusions slidable in the slots for controlling an opening range of the cover; and wherein the cover and the pair of supporting components are mateable with each other in condition that one of the cover and the pair of supporting components pivots clockwise while a remaining one of the cover and the pair of supporting components pivots anticlockwise.

13. The slidable electrical connector as claimed in claim 12, wherein slide of the base accompanies pivot of the cover.

14. The slidable electrical connector as claimed in claim 12, wherein the base is located between the rail brackets, each rail bracket comprising a body portion and a rib protruding inwardly from the body portion, the base comprising a pair of side walls each of which defines a guide slot to receive corresponding rib, the ribs and the guide slots being slidable with each other.

15. The slidable electrical connector as claimed in claim 14, further comprising a pair of deformable members respectively mounted to the rail brackets, each side wall further comprising a first depression and a second depression separated a distance along the front-to-back direction; wherein when the base is at the close position, the deformable members protrude into the first depressions; and wherein when the base is at the open position, the deformable members protrude into the second depressions.

16. The slidable electrical connector as claimed in claim 15, wherein each body portion comprises a mounting hole and corresponding deformable member is inserted into the mounting hole along a transverse direction perpendicular to the front-to-back direction.

17. The slidable electrical connector as claimed in claim 12, wherein the base comprises a recess to which force can be applied in order to pull out the base from the rail brackets.

18. The slidable electrical connector as claimed in claim 12, further comprising a shell banding the base and the rail brackets, the shell comprising a bottom portion and a pair of vertical portions extending upwardly from the bottom portion, the base and the rail brackets being restricted by the pair of vertical portions.

19. The slidable electrical connector as claimed in claim 12, wherein the first pivot member comprises a pair of first shafts formed on lateral sides of the cover, a pair of mounting holes formed in the base and an axis extending through the first shafts and the mounting holes; and wherein the second pivotal member comprises a pair of round holes formed on the pair of supporting components, respectively, and a pair of second shafts formed in the base, the pair of second shafts being pivotal in the round holes.

20. The slidable electrical connector as claimed in claim 12, wherein the protrusions are located between the first pivotal member and the second pivot member along the front-to-back direction while a center line of the first pivot member is lower than that of the protrusions.

* * * * *